United States Patent [19]

Lipowski et al.

[11] 4,196,820

[45] Apr. 8, 1980

[54] FLUID TIGHT CLOSURE OF THERMOSETTING PLASTIC FOIL

[75] Inventors: Helmut Lipowski; Werner Andrä, both of Dresden, German Democratic Rep.

[73] Assignee: Institut fur Leichtbau und Ökonomische Verwendung Von Werkstoffen, Dresden, German Democratic Rep.

[21] Appl. No.: 950,631

[22] Filed: Oct. 11, 1978

[51] Int. Cl.[2] ..... B65D 41/22

[52] U.S. Cl. ..... 215/317; 215/326

[58] Field of Search ..... 215/326, 317, 320, 321, 215/324, 246; 53/441, 442, 488

[56] References Cited

U.S. PATENT DOCUMENTS

| | | | |
|---|---|---|---|
| 2,604,223 | 7/1952 | Horning | 215/321 |
| 2,772,802 | 12/1956 | Woydatt | 215/320 X |
| 2,869,746 | 1/1959 | Wilcox | 215/321 |
| 2,885,105 | 5/1959 | Heyl et al. | 215/246 |
| 2,947,432 | 8/1960 | Marcel | 215/321 |
| 3,189,208 | 6/1965 | Jowett | 215/246 |
| 3,862,614 | 1/1975 | Kovac | 215/317 |

FOREIGN PATENT DOCUMENTS

| | | | |
|---|---|---|---|
| 560419 | 7/1958 | Canada | 215/317 |

*Primary Examiner*—Donald F. Norton
*Attorney, Agent, or Firm*—Michael J. Striker

[57] ABSTRACT

The closure is made of a thermosetting plastic foil that is brought in contact with a projecting lip on the rim of a bottle neck whereby a central part of the foil is irreversibly deformed by heating and stretching over the upper surface of the lip. The closing of the bottle by stretching the heated foil portion is made in a single operational step.

6 Claims, 4 Drawing Figures

FLUID TIGHT CLOSURE OF THERMOSETTING PLASTIC FOIL

BACKGROUND OF THE INVENTION

This invention is concerned generally with sealing all kinds of liquid containers having a profiled rim portion (lip) and charged with a nonpressurized fluid or with a liquid that produces a limited internal pressure and that upon completion of the filling operation are not subject to any heat treatment. Furthermore, this invention is concerned with sealing containers that upon completion of the filling operation and upon their closure are reopened and closed again only once or a limited number of times.

Prior art fluid-tight closures made of plastic material have been described for example in the periodical Z-Konstruktion 28 (1976), copy 7, page 257, published by Springer Verlog, Federal Republic of Germany. The closures disclosed in this periodical are of the type suitable for closing bottles or tubes having interface sealing means and using for the multiplication of sealing force elbow levers, simple wedges or double wedges and threads. The closures of this type are complicated in structure and costly in manufacture and are designed for frequent alternation of their function, that means for repeated closing and opening of the container.

Another technical solution is described in the German Pat. No. 2,512,882 which discloses a shrinkable plastic foil bent over the rim of a container so that upon its heating the foil due to the shrinking effect hermetically seals the rim. The disadvantage of the shrinkable foil is the fact that wrinkles and folds resulting from bending the foil over the projecting rim portion, are not eliminated during the shrinking process so that this type of closure is applicable for bottles having short rim portions only. Considering closures of another material such as crown cork closures or aluminum disk caps conventional for closing bottle necks, they have the disadvantage that upon opening the bottle they cannot resume their sealing function.

SUMMARY OF THE INVENTION

It is therefore a general object of the present invention to overcome the aforementioned disadvantages.

More particularly, it is an object of this invention to provide an improved tight closure for fluid containers having a profiled rim portion that is simple in structure and inexpensive to manufacture.

Another object of this invention is to provide a closure that performs its sealing function even after repeated opening of the container.

In keeping with these objects, and others which will become apparent hereafter, one feature of the invention resides in a liquid-tight closure for use in connection with bottles having profiled rim portions defining a projecting lip, which comprises an irreversibly deformable or thermosetting plastic foil that is heated at its central part corresponding in size approximately to the area bounded by the perimeter of the bottle opening or the rim and stretched over the profiled rim portion of the bottle and thereby irreversibly extending over the projecting lip. The irreversibly expanded central portion and the remaining non-heated marginal portion of the foil insure that they sealingly cover the rim part of the bottle even after repeated removal provided that a pliant foil used. Containers having a profiled rim portion and charged with a liquid that produce an internal pressure can be sealed by a rigid foil of thermosetting material in the same manner as by the pliant foil.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
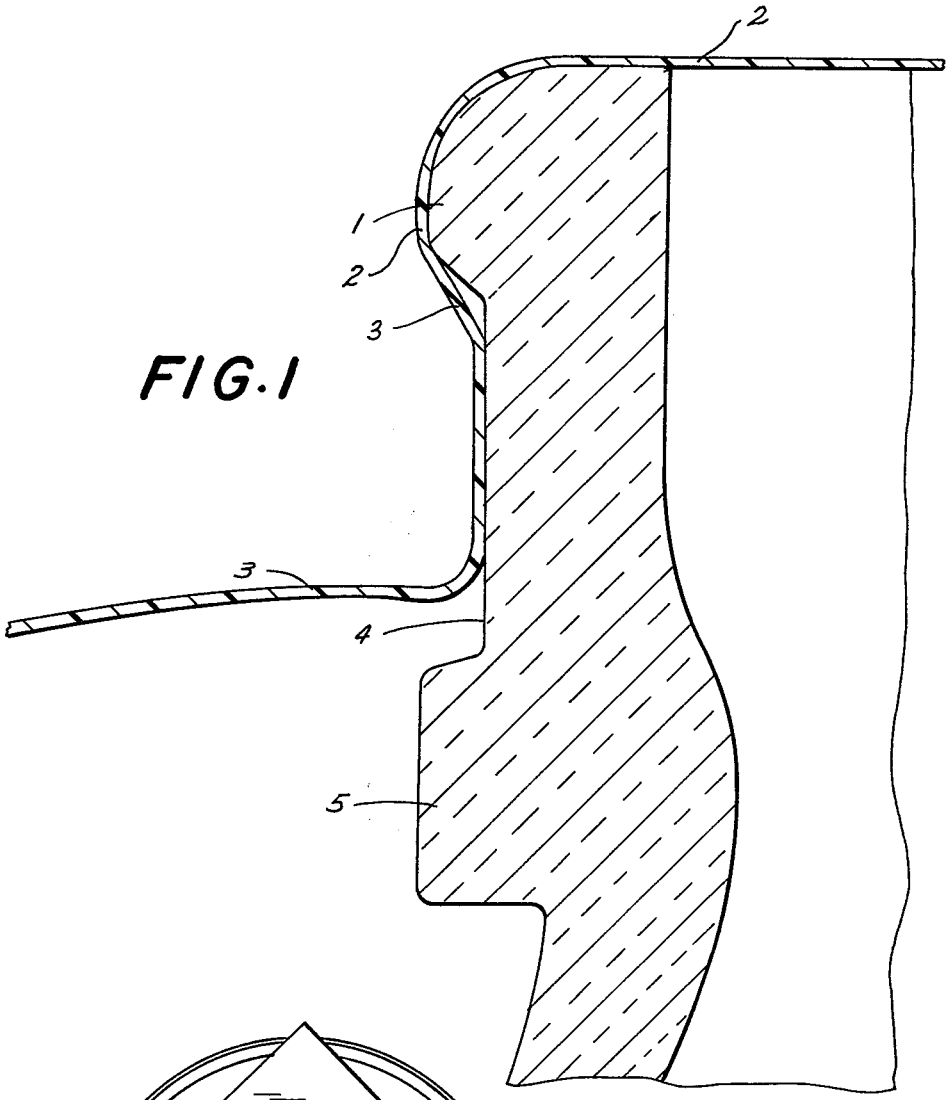
FIG. 1 is a sectional side view of the upper part of a standard bottle provided with a closure according to this invention.
Figure 2:
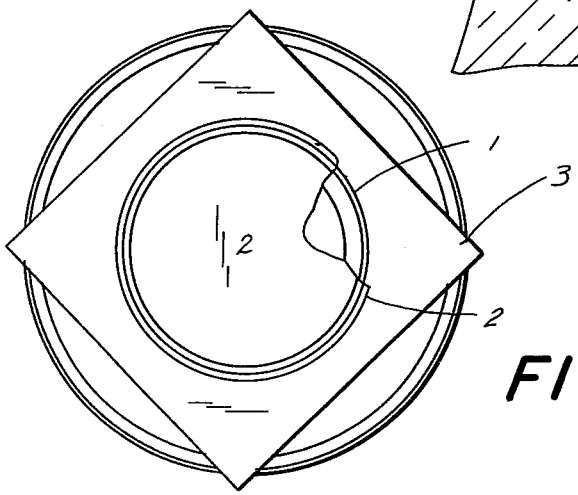
FIG. 2 is a partly cut-away top view of the liquid tight closure according to this invention.
Figure 3:
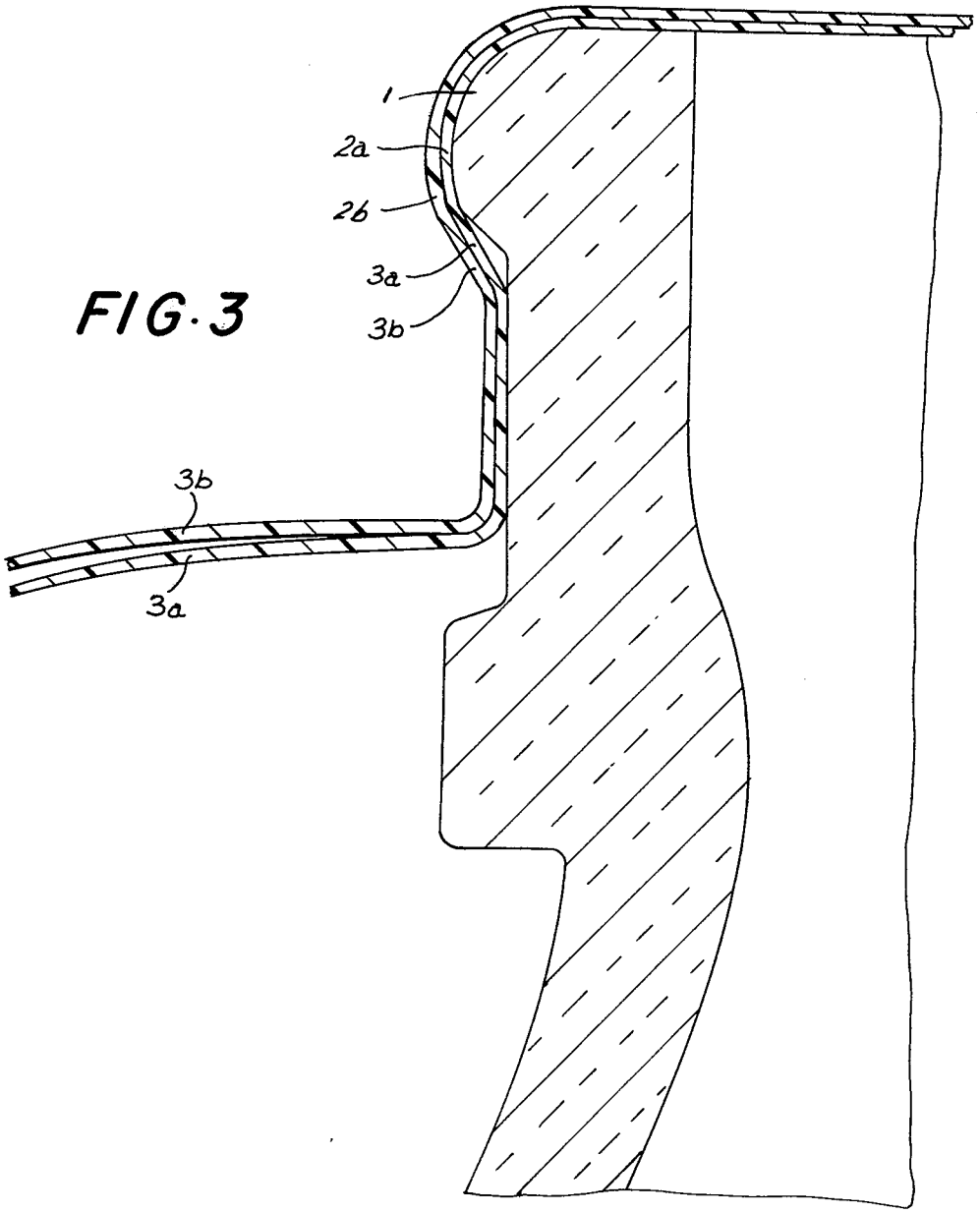
FIG. 3 is a side view of a modification of the closure according to this invention.

Referring to FIGS. 1 and 2, there is shown on an enlarged scale a standard milk bottle having a shaped neck portion defining a projecting rim or lip 1 followed by a recessed neck portion 4 that again is terminated with a projecting collar 5. A pliant foil of an irreversibly deformable or thermosetting plastic material such as, for instance of PVC (polyviny chloride) or PE (polyethylene) is heated at its central portion 2 and stretched over the curved sealing surfaces of the projecting lip 1 so that this central part 2 of the foil is irreversibly expanded and retains its shape even when the foil is removed. The non-heated marginal part 3 of the foil below the projecting lip portion 1 is left in its original state without subjecting it to any stretching or other deformation. As seen from FIG. 2, the marginal part 3 of the foil bridges the corner area between the lower surface of the rim 1 and the upper part of the neck 4 and subsequently it tightly surrounds the neck 4. The foil has a square configuration, but many other configurations are possible. FIG. 3 shows an embodiment where two superposed foils are stretched over the bottle neck. Due to the frictional forces the two foils **2*a* and 2*b*** maintain their mutual position and this reinforcement makes it possible to use it for closing containers in which internal pressure exceeds the atmospheric pressure.

Figure 4:
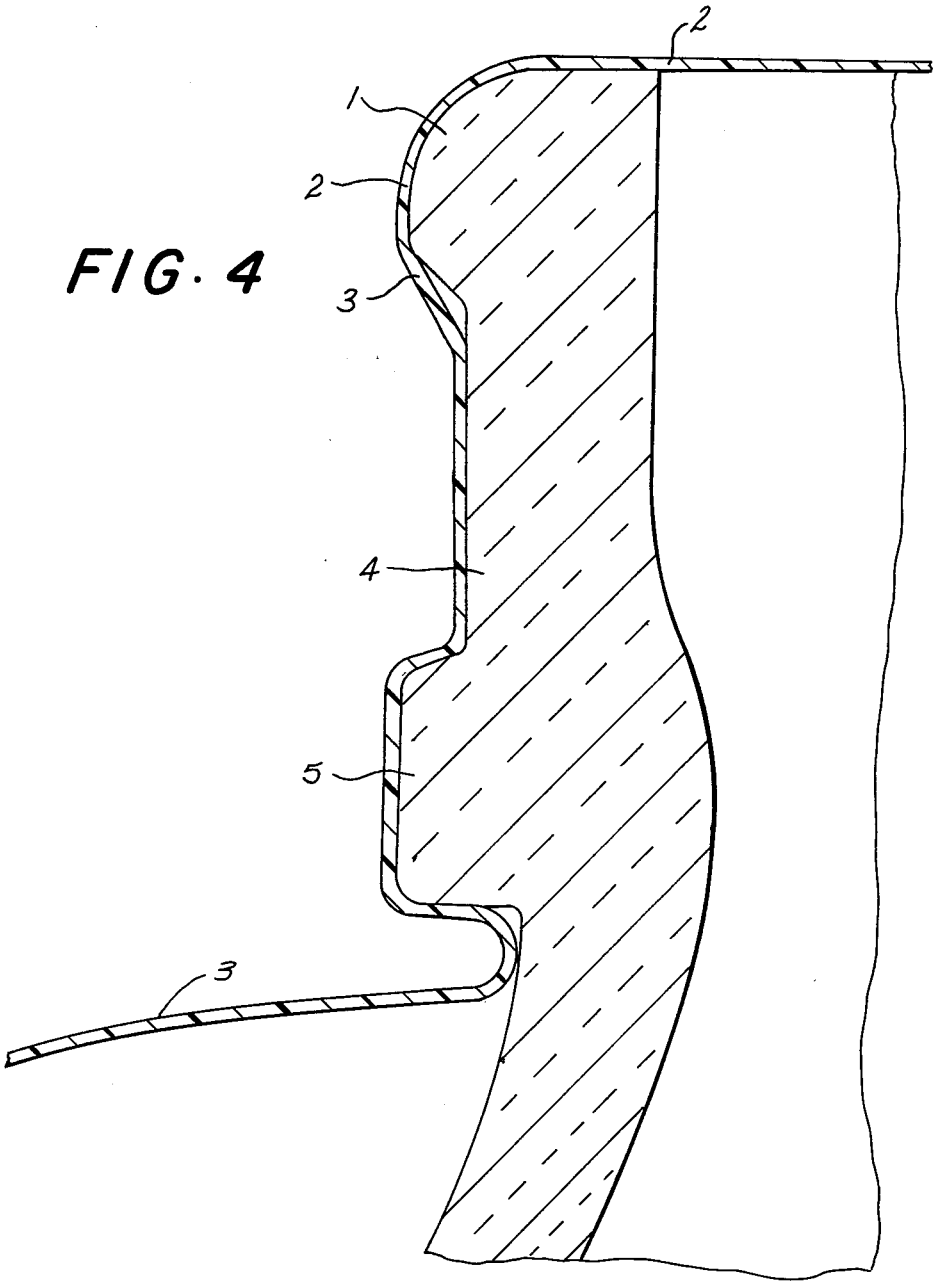
FIG. 4 is a side view of still another modification of the closure of this invention.

FIG. 4 shows a single foil closure where the non-heated portion 3 of the foil is extended and stretched over the projecting lower collar 5 of the shaped bottle neck.

It will be understood that each of the elements described above, or two or more together, may also find a useful application in other types of constructions differing from the types described above.

While the invention has been illustrated and described as embodied in connection with a standard milk bottle, it is not intended to be limited to the details shown, since various modifications and structural changes may be made without departing in any way from the spirit of the present invention.

What is claimed as new and desired to be protected by Letters Patent is set forth in the appended claims:

1. A fluid tight closure in combination with a container having a profiled neck portion defining a projecting rim about its opening, comprising a foil of a thermosetting plastic material, a central part of said foil being heat treated and irreversibly shaped by stretching over said rim and the remaining untreated marginal part of said foil below said rim tightly surrounding said neck portion.

2. A closure as defined in claim 1 wherein said foil is of a pliant plastic material.

3. A closure as defined in claim 1 wherein said foil is of a rigid plastic material.

4. A closure as defined in claim 1 wherein said neck portion includes an additional rim below said first mentioned rim and said marginal part of said foil is stretched over the entire length of said neck portion.

5. A closure as defined in claim 1, wherein the marginal part of the foil under the projecting rim portion of the bottle bridges the corner area between the lower surface of said rim and the upper part of said neck.

6. A closure as defined in claim 1, wherein two superposed foils of irreversibly deformable plastic material are stretched over the rim portion of the bottle.

* * * * *